US005730821A

United States Patent [19]

Joest et al.

[11] Patent Number: 5,730,821

[45] Date of Patent: Mar. 24, 1998

[54] PROCESS FOR PRODUCING A WEB OF THERMOPLASTIC POLYMER FILAMENTS

[75] Inventors: Rolf Helmut Joest, Duisburg; Hans Georg Geus, Niederkassel; Hermann Balk, Troisdorf; Bernd Kunze, Hennef; Herbert Schulz, Troisdorf, all of Germany

[73] Assignee: Reifenhauser GmbH & Co. Maschinenfabrik, Troisdorf, Germany

[21] Appl. No.: 585,683

[22] Filed: Jan. 16, 1996

[30] Foreign Application Priority Data

Jan. 17, 1995 [DE] Germany ..... 195 01 125.2

[51] Int. Cl.[6] ..... D04H 3/16

[52] U.S. Cl. ..... 156/167; 156/181; 156/229; 264/210.8; 264/290.2; 264/290.5

[58] Field of Search ..... 156/62.4, 167, 156/180, 181, 229; 264/290.5, 210.8, 290.2

[56] References Cited

U.S. PATENT DOCUMENTS

| | | |
|---|---|---|
| 3,855,045 | 12/1974 | Brock . |
| 3,912,567 | 10/1975 | Schwartz . |
| 3,949,128 | 4/1976 | Ostemeier . |
| 4,340,563 | 7/1982 | Appel et al. . |
| 4,405,297 | 9/1983 | Appel et al. . |
| 5,244,724 | 9/1993 | Antonacci et al. . |
| 5,296,289 | 3/1994 | Collins . |

FOREIGN PATENT DOCUMENTS

| | | |
|---|---|---|
| 1 900 265 | 7/1969 | Germany . |
| 40 14 414 A1 | 11/1991 | Germany . |
| 40 14 989 A1 | 11/1991 | Germany . |
| 1213441 | 11/1970 | United Kingdom . |

OTHER PUBLICATIONS

"Verfahren zur Herstellung von Filamentgarnen aus thermoplastischen Polymeren", ITB Garn- und Flachenherstellung, Feb. 1994, Dr. Klaus Meier, pp. 8–11.

*Primary Examiner*—Michael W. Ball
*Assistant Examiner*—Sam Ohuan Yao
*Attorney, Agent, or Firm*—Herbert Dubno

[57] ABSTRACT

A process for producing a web fleece of thermoplastic polymer filaments. Filaments of thermoplastic polymer are spun from a spinneret to form a curtain passing through a cooling chamber and a stretching channel. The volume rate of flow of the thermoplastic polymer from the spinneret, the volume rate of flow of air, the velocity of the air and the temperature of the air in the cooling chamber and stretching channel are so controlled that individual filaments of the curtain have filament diameters less than μm and a degree of crystallinity less than 45%. The filaments of the curtain are collected on a continuously moving sieve belt in a mat whose crossing points fuse together. The mat is heated to a stretching temperature of 80° to 150° C. and stretched axially by 100 to 400%. The biaxially stretched mat is heated to a temperature above that of the stretching temperature to thermofix the web.

20 Claims, 2 Drawing Sheets

PROCESS FOR PRODUCING A WEB OF THERMOPLASTIC POLYMER FILAMENTS

FIELD OF THE INVENTION

The present invention relates to a process for producing a mat or fleece of thermoplastic polymer filaments from thermoplastic polymers having two supermolecular states of order, namely, a crystallite state and an amorphous state. The invention, in particular, relates to the formation of a high strength web of nonwoven polymer filaments which can be produced by depositing the spun filaments.

BACKGROUND OF THE INVENTION

Thermoplastic polymers are known which have two supermolecular states of order, namely, a crystallite state, i.e. a state in which the polymer is primarily crystalline, and an amorphous state.

Polymer filaments are filaments or threads of substantial length, for example, endless threads and monofilaments. They contrast with polymer fibers, i.e. relatively short fibers, also known as staple fibers.

Polymers which are suitable for the present invention and have such states include polyamides, polyesters, polyethylene and polypropylene. Especially suitable for the purposes of the present invention are polyamide 6 (nylon 6) and polyamide 6.6 (nylon 66) and polyethyleneterephthalate.

Other polymers which have these states can, however, also be used for the purposes of the present invention.

The dominating parameters of the crystallite state are the chain packing in the crystal structure, the degree of crystallinity, the crystallite orientation and the crystallite size. In such polymers, the chain packing in the crystallite structure is practically not influenced by the conditions under which the polymer is worked up. By contrast, however, the degree of crystallinity and especially the crystallite orientation can be highly influenced by the processing operation. Since the crystallite structure is especially stable, the chain molecules do not tend to fold back upon themselves. The shrinkage of the filaments decreases with increasing degree of crystallinity. The crystallite component affects strength only when the crystallite orientation is along the filament axis. The crystallinity degree or degree of crystallinity decreases with increasing cooling speed. A higher degree of orientation of the molecule chains in the crystalline structure brings about a high degree of crystallinity. Reference herein to "orientation", is intended to refer to the orientation of the molecular chains in the amorphous state as well as orientation of the crystallites. Upon stretching of the filaments, the molecules tend to orient in the direction of stress and thus the molecules and crystallites tend to orient in the same direction, namely, the direction of stretch.

The degree of orientation depends, therefore, strongly on the thermal and mechanical stretching conditions. The degree of orientation for particular thermal and mechanical stretching conditions can be determined without difficulty empirically and experimentally. With increasing orientation, there is an increasing strength of the filaments and simultaneously a reduction in the elongation and shrinkage properties. In the melt, the chain molecules are without orientation and appear to twist about one another and to assume a random disposition (compare ITB Garn- und Flächenherstellung 2/94, Pages 8,9).

Processes for producing fleeces or mats of thermoplastic polymer filaments are known in a number of embodiments (see, especially U.S. Pat. Nos. 4,340,563, 4,405,297, 3,855,045, 5,296,289, German Patent 40 14 414 and German Patent 40 14 989). Polymer filaments start out as polymer melts and are extruded from the nozzle orifices of a so-called spinneret. The filaments emerging from this spinneret form a filament curtain. This filament curtain can pass through a cooling chamber and are contacted therein with process or cooling air. The filament curtain then passes through a stretching channel, i.e. a channel which is constricted to increase the velocity of the air flow therethrough. The filaments are accompanied by process air in their flow through this channel and can be considered to be entrained in the process air. Since the process air stream can have a velocity greater than that of the filaments, the filaments are stretched. The process air may be formed by the cooling air and, conversely, process air can be used for cooling purposes.

The stretched polymer filaments are deposited on a continuously moving sieve belt to form the mat. In general, process air is sucked through the sieve belt which assists in pressing the filaments against the belt and thus pressing the filaments against one another as they randomly deposit on the belt.

During the mat deposition step, the polymer filaments cross over one another and bond together, i.e. fuse together at crossing points which are thus points at which the filaments weld together.

It is known, in this connection, to heat a mat of this type to a stretching temperature (German Patent 19 00 265) and to stretch it both in the longitudinal direction and in the transverse direction, i.e. biaxially. Naturally, a stretching biaxially of the mat or fleece will reduce the area weight, i.e. the weight per unit area thereof.

It is also known (see U.S. Pat. No. 5,296,289) to form the fleece or mat with pointlike weld structures distributed both in the longitudinal and in the transverse directions over the mat and having diameters in the millimeter range. The mat may be subjected to calendering between rolls of which one generally at least is heated. The polymer filaments which are used in these systems generally have a relatively large diameter, usually over 100 μm. The area weight is correspondingly high. The degree of crystallinity of the polymer filaments which are deposited upon the sieve belt is also proportionately high. This degree of crystallinity determines correspondingly the physical parameters of the polymer filaments in the mat and thus the physical parameters of the fleece or mat itself. Even when the mat is subjected to a biaxial stretching with subsequent thermal fixing, the area weight is relatively high compared to the strength. In other words, the strength for the given area weight requires improvement or the area weight should be reduced for the given mat strength.

OBJECTS OF THE INVENTION

It is, therefore, the principal object of the present invention to provide a process utilizing features of prior art processes with respect to the deposition of the mat from polymer filaments, stretching and thermal fixing, whereby, however, the area weight for a given strength of the mat can be reduced or the strength of the mat can be increased for a given area weight.

It is also an object of the invention to improve upon processes for producing thermoplastic polymer filament fleeces of the type described which will allow increasing the strength of the fleeces while reducing the yield and residual shrinkage.

The invention is also intended to solve the problem of providing, for a given strength of the fleece, a reduced area weight with reduced elongation to break and reduced shrinkage.

A more general object of the invention is to provide an improved process for making a fleece for the purposes described which will allow the physical properties of the fleece to be greatly improved.

SUMMARY OF THE INVENTION

These objects are attained, in accordance with the invention, in a process for producing a fleece or mat of thermoplastic polymer filaments composed of polymers having two supermolecular states of order, namely, a crystallite state and an amorphous state. According to the invention, the process is characterized by the features:

(1.1) For the generation of the polymer filament, a spinneret is used followed by a cooling chamber and a stretching channel as has been described above, operated with cooling air and/or with stretching process air.

(1.2) The volume rate of flow of the polymer stream from the spinneret, the volume rate of flow of the cooling air and/or of the stretching process air, the speed and the temperature and/or the stretching process air are so selected that the individual polymer filaments have a filament diameter of less than 100 μm and a degree of crystallinity less than 45%.

(1.3) The polymer filaments formed in accordance with the feature 1.1 are deposited on a continuously moving sieve belt and formed at crossing points of the polymer filament, bonding or welding location, i.e. crossover welding location, which result in a crude fleece.

(1.4) The crude fleece produced in accordance with the feature 1.3 is heated to a stretching temperature and in a range of 100% to 400% is stretched both longitudinally and transversely, i.e. biaxially.

(1.5) This stretched crude fleece is subjected to thermofixing at a temperature which is higher than the stretching temperature to produce a thermally fixed fleece or web.

According to a feature of the invention, the stretching according to feature 1.4 and the thermofixing according to feature 1.5 are so carried out that the polymer filaments in the finished fleece have a degree of crystallinity of at least 50% at the centers of these filaments. Preferably, the filament diameter of the individual polymer filaments resulting from feature 1.2 is under 50 μm and most advantageously in the range of 15 to 30 μm.

Preferably the degree of crystallinity of the finished fleece is above 50%, most advantageously between 75 and 80%.

The polymer filaments emerge from the nozzle orifices of the spinneret with an amorphous structure. Surprisingly, the cooling and the stretching are so carried out that the solidified polymer filaments have only the indicated reduced degree of crystallinity which gives rise to substantial advantages.

The deposited polymer filaments can be passed through a calender to improve the bonding between the polymer filaments at their crossover points. In a preferred embodiment, point weld structures distributed over the longitudinal and transverse directions of the mat following the feature 1.3, have diameters of at least 1 mm and the mat is then passed through a calendar apparatus at least one roll of which is heated, whereupon the biaxial stretching (feature 1.4) and the thermal fixing (feature 1.5) are carried out.

The invention is based upon the surprising discovery that by control of the volume rate of flow of the polymer from the spinneret, the volume rate of flow of the cooling air and/or the stretching process air, the velocity and temperature of the cooling air and/or of the process air can be so controlled that the individual polymer filaments have the filament diameters and degree of crystallinity given in feature 1.2.

Surprisingly, these polymer filaments can be deposited with the feature 1.3 as described to yield a mat which is coherent in that the filaments bond at their crossover points.

The polymer filaments as fabricated in accordance with the teachings of the invention have a reduced filament diameter by comparison with earlier systems as is apparent from the feature 1.2. Notwithstanding this reduced filament diameter, without breakage of the filaments and without rupture of the crossover welds, the biaxial stretching can be carried out with a high degree of stretch, namely, 100 to 400%. The result is a fleece which, for a given high strength can have a substantially reduced area weight or, for a fleece of a certain area weight, can have a much greater strength.

The invention thus allows a saving in the polymer which is used to achieve desired results. The invention can operate when the welds at the crossover points are point welds or when these welds are structured by funnel-shaped formations of the polymer which are drawn flat during the stretching operation.

Of course, in the finished fleece there may be numerous breaks in the polymer filaments and at the weld sites, although these breaks are generally so few in number that they have no adverse affect on the properties of the web.

According to a feature of the invention, the stretching (feature 1.4) is so carried out that at the crossover welds or fusion points, the bond between the filaments is undisturbed. When the polymer is selected from the group which consists of polyamides, polyesters, polyethylene and polypropylene, the stretching can be carried out (feature 1.4) with a degree of stretching of about 300%.

It has been found that the stretching in accordance with the feature 1.4 should best be carried out with a stretching temperature in the range of 80° to 150° C. and the thermal fixing in accordance with feature 1.5 at a thermal fixing temperature in the range 120° to 200° C. A cooling can follow the thermal fixing. Preferably the thermal fixing is carried out in accordance with the invention using hot air and surfaces of the polymer filaments are at least partly melted during the thermal fixing. This feature has been found to increase the resistance to breakage of the polymer filaments.

According to a feature of the invention, the point weld structural elements are, as noted above, funnel-shaped or conical structures which are drawn flat during the biaxial stretching. A nonthrough-welded funnel is one in which the polymer filaments retain at least some of their integrity at the weld cites, i.e. one in which there is no homogeneous transition between the filaments although they are bonded together. When the weld funnels are drawn flat, they tend to lose their funnel-shape at least as is apparent to the naked eye.

According to still another feature of the invention, the stretching in feature 1.4 and the thermal fixing in the feature 1.5 can be carried out inline with the production of the thermoplastic filaments. An inline operation signifies that the production of the polymer filaments, the formation of the mat by depositing the filaments, the stretching and the thermal fixing are effected in a single apparatus. It is also possible, however, to carry out the stretching and the thermal fixing off line from the production of the filaments and the initial mat. In this case, the initial mat is a raw product which can be finished subsequently.

The fleece of the invention can be used for all of the purposes that the polyamide, polyester and polyolefin fleeces have been used heretofore for and have as effective a strength, resistance to shrinkage and resistance to stretching as earlier fleeces of much greater area weights.

The fleece can be cut up, laminated with other materials and with other layers of the same fleece or bonded into a wide variety of structures.

The process of the present invention can then be considered to comprise:

a process for producing a web of thermoplastic polymer filaments of a thermoplastic polymer having a supermolecular crystalline state and a supermolecular amorphous state, the process comprising the steps of:

(a) spinning filaments of the thermoplastic polymer by feeding the thermoplastic polymer in as molten state to a spinneret and extruding the molten thermoplastic polymer from orifices of the spinneret in a filament curtain;

(b) cooling the filaments of the curtain and stretching the filaments of the curtain by passing the filament curtain through a cooling chamber and a stretching channel connected with the cooling chamber while supplying the cooling chamber and the stretching channel with cooling or stretching-process air;

(c) controlling a volume rate of flow of the thermoplastic polymer from the spinneret, a volume rate of flow of air in step (b), a velocity of the air in step (b) and a temperature of the air in step (b) so that individual filaments of the curtain have filament diameters less than 100 μm and a degree of crystallinity less than 45%;

(d) collecting filaments of the curtain on a continuously moving sieve belt in a mat of filaments having crossing points at which the filaments fuse together;

(e) heating the mat to a stretching temperature and stretching the mat at the stretching temperature biaxially in a longitudinal direction and in a transverse direction by 100% to 400% to form a biaxially stretched mat; and (f) heating the biaxially stretched mat in a thermofixing operation to a temperature above the stretching temperature to thermally fix the mat and form the web, the stretching in step (e) and the thermofixing in step (f) being so carried out that the polymer filaments of the web have at their centers a degree of crystallinity of at least 50%.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
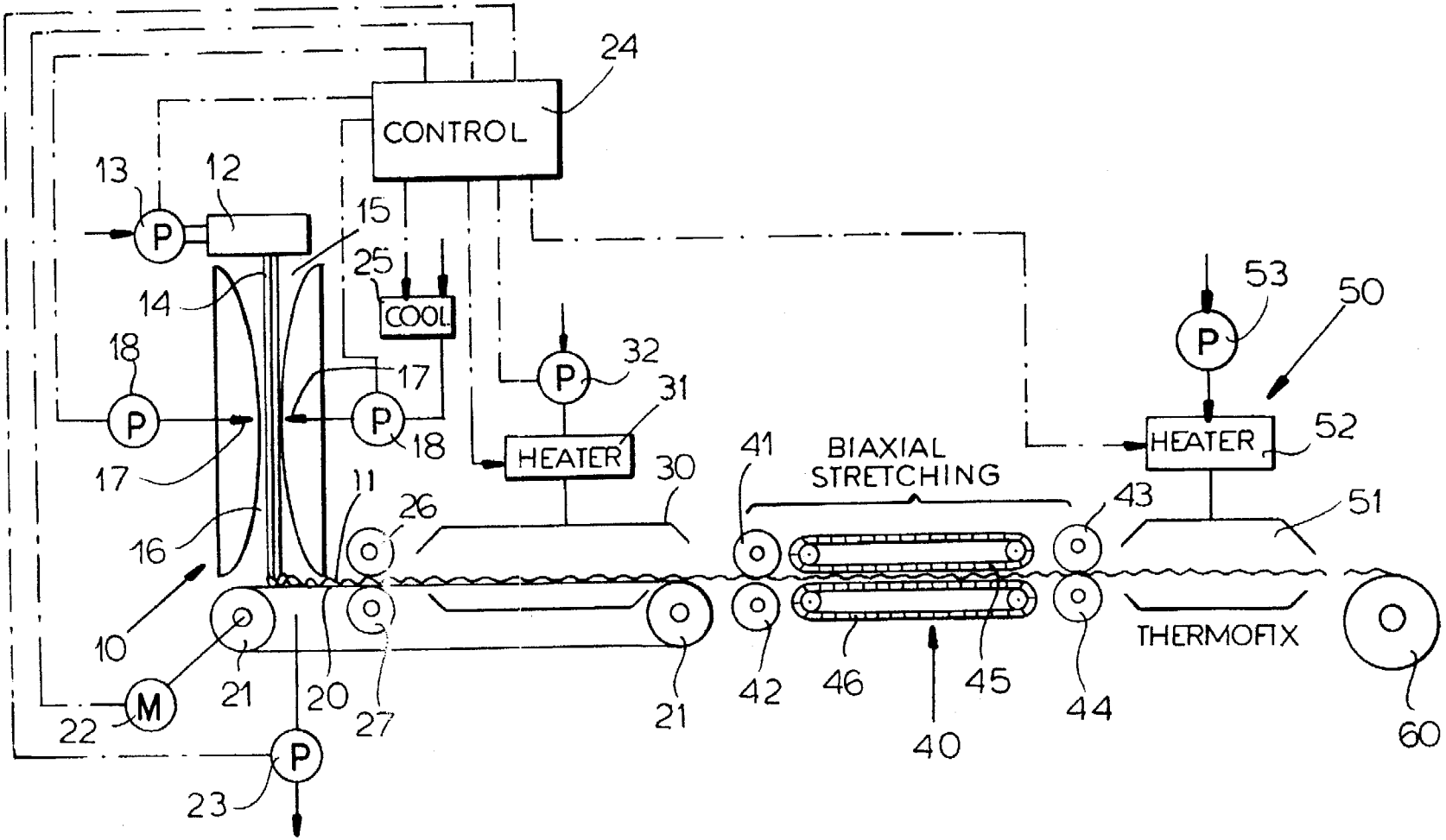
FIG. 1 is a diagrammatic side elevational view of an apparatus for carrying out the method of the invention.

In FIG. 1 we have shown an apparatus 10 for producing a thermoplastic filament mat 11 which comprises a spinneret 12 which is supplied with the molten thermoplastic via a pump 13. The volume rate of flow of this pump is determined by a control 14.

The curtain of thermoplastic monofilaments 14 descending from the spinneret, passes through a cooling chamber represented at 15 followed by a stretching channel 16. The cooling air supply is represented by the arrows 17 and is supplied by blowers 18 also under the control of the control unit 24 mentioned previously. The cooling chamber and stretching channel may correspond to those of the aforementioned U.S. patents. The monofilaments are collected in the mat 11 on a sieve belt 20 which is displacable on rollers 21 driven by a motor 22 operated by the controller 24. The suction applied beneath the sieve belts 20 via the pump 23 is likewise determined by the controller 24. The air fed to the cooling chamber and stretching channel can be cooled as represented by the cooling unit 25 under the control of the control unit 24.

The mat 11 passes between rolls 26 and 27 which may be heated and form a calender to compress the filaments of the mat against one another.

Downstream of the calendar 26, 27, is a heating zone 30 in which the mat 11 is contacted with hot air supplied by a heater 31 and a blower 32, the latter being operated by the controller 24. The temperature of the heater 31 is also controlled by the control unit 24.

Under the hood or in the heating stage 30, the mat is brought to the stretching temperature before it enters the biaxial stretching zone 40. The latter can comprise roll pairs 41 and 42 engaging the mat 11 at an upstream location and a roll pair 43, 44 engaging the mat at a downstream location. The speed of the rollers 43, 44 can be between two and four times the speed of the rollers 41, 42 to ensure a longitudinal stretch in the range of 100 to 400% as previously described. The longitudinal edges of the web are engaged between chains 45 and 46 at one side and between a corresponding pair of chains at the opposite side, the chains diverging from the roller pair 41, 42 to apply a transverse stretch to the web which has been heated to the stretching temperature at 30.

Downstream of the biaxial stretching stage 40, the mat enters a thermal fixing stage 50 in which it is subjected to heating under the hood 51 by hot air from the heater 52 and supplied by the blower 53. The mat is brought to a temperature above the stretching temperature in the thermal fixing stage and preferably to a temperature at which surfaces of the polymer filaments are partly melted. After cooling, the mat can be wound up on a roll 60.

Figure 2:
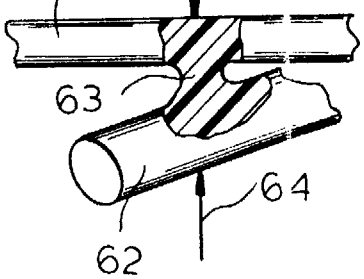
FIG. 2 is a detailed view partly in section showing a fusion at a crossover point between two filaments prior to calendaring.
Figure 3:
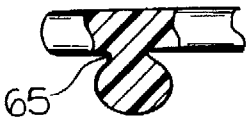
FIG. 3 is a view similar to FIG. 2 after calendaring.
Figure 4:
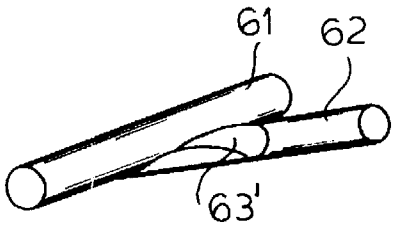
FIG. 4 is a view showing a stretched intersection with fusion of the filaments together.

As can be seen from FIG. 2, the initial fusion bond between filaments 61 and 62 can have funnel-shaped structures as shown at 63. The filaments can be compressed in the direction of arrows 64 in the calendar 26, 27 to form junctions 65 (FIG. 3) of diameters of 1 mm or more. Alternatively or in addition, the stretching in stage 40 can draw out the junction 63 as shown at 63' in FIG. 4 to a flattened state.

In operation, the filaments are formed at 10 by spinning of the thermoplastic polymer with the filaments of the curtain 14 being cooled and stretched by passing through the cooling chamber 15 and the stretching channel 16.

The volume rate of flow of the thermoplastic polymer from the spinneret (controlled by the control unit 24 and the pump 13), the volume rate of flow of the air via the pumps 18 and the control unit 24 and the velocity of the air and the temperature are so regulated by the control unit 24 that the individual filaments of the curtain have filament diameters less than 100 μm and a degree of crystallinity less than 45%.

The mat is heated to a stretching temperature of, say, 80° to 150° C. at 30 and is biaxially stretched by 100 to 400% to form the biaxially stretched mat entering the thermal fixing station 50. There the biaxially stretched mat is heated to a temperature of 180° to 200° C. and is thermally fixed. The stretching and the thermal fixing are so carried out that the polymer filaments have at their centers a degree of crystallinity of at least 50%.

EXAMPLE

The process is carried out utilizing a polypropylene polymer. The mat is then partly preheated by rollers and may be further heated by a heating unit as shown in FIG. 1. The number of heating rollers and the degree of heating will depend upon the area weight and the speed of the web. The web leaving the prestretching stage is at a temperature of 130° to 150° C. The residence time in the prestretching heating stage is 3 to 20 seconds and the mat is displaced at a speed of 20 to 200 m/min.

Figure 5:
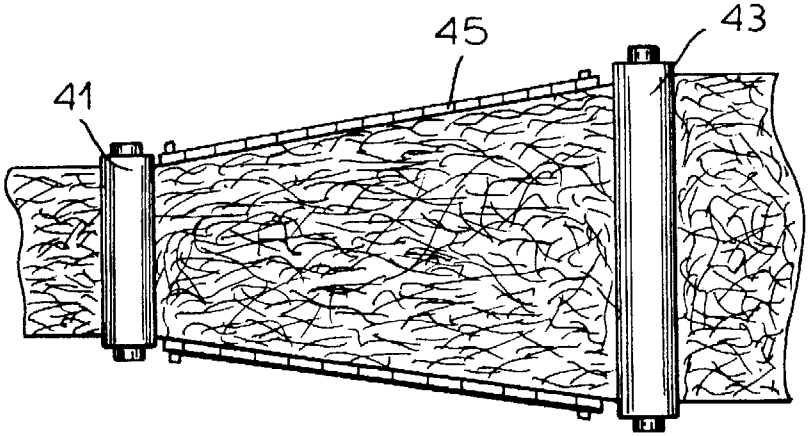
FIG. 5 is a plan view diagrammatically illustrating the stretching operation in FIG. 1.

The mat is then longitudinally stretched in one or more stages and heating rollers of the type described can be provided in this stage as well to maintain the stretching temperature. The stretching zones can be of variable length and determine the stretching ratio. The length of the stretching gap is from 3 to 30 mm and the stretching ratio can be 1:1.2 to 1:3.0. The stretching gap is defined between heated pressing rolls and may be fixed. The downstream roll pairs, of course, operate at a higher rate. The monoaxially oriented mat can then be subjected to transverse stretching. The transverse stretching can be carried out in a number of further zones downstream of the longitudinal stretching zone. The mat can be reheated to the stretching temperature between such zones. Alternatively, the stretching can be carried out with chains which engage the edges of the mat as shown in FIG. 5. The transverse and longitudinal stretching zones may alternate with one another. The paper of the stretching process is dependent upon the mat before stretching, the desired isotropy of the finished product and the stretching ratio. In substantially all cases, the stretching ratio can lie in the range of 1:1.5 to 1:3.5 with the conicity between 0.5 and 12 percent. The stretching temperature can be 140° to 175° if desired. The thermofixing, however, is effected at 180° to 200° C.

The finished fleece or web has the following characteristics:

| | |
|---|---|
| area weight | ($g/m^2n$) |
| capillary titer (dtex) | 1.8 |
| Tear Resistance MC/Cd | (N/5 cm) 28/21 |
| Elongation at tear MC/CD (%) | 25/25 |

We claim:

1. A process for producing a web of thermoplastic polymer filaments of a thermoplastic polymer having a supermolecular crystalline state and a supermolecular amorphous state, said process comprising the steps of:

(a) spinning filaments of said thermoplastic polymer by feeding the thermoplastic polymer in as molten state to a spinneret and extruding the molten thermoplastic polymer from orifices of the spinneret in a filament curtain;

(b) cooling the filaments of said curtain and stretching said filaments of said curtain by passing said filament curtain through a cooling chamber and a stretching channel connected with said cooling chamber while supplying said cooling chamber and said stretching channel with cooling or stretching-process air;

(c) controlling a volume rate of flow of said thermoplastic polymer from said spinneret, a volume rate of flow of air in step (b), a velocity of the air in step (b) and a temperature of the air in step (b) so that individual filaments of said curtain have filament diameters less than 100 μm and a degree of crystallinity less than 45%;

(d) collecting filaments of said curtain on a continuously moving sieve belt in a mat of filaments having crossing points at which said filaments fuse together;

(e) heating said mat to a stretching temperature and stretching said mat at said stretching temperature biaxially in a longitudinal direction and in a transverse direction by 100% to 400% to form a biaxially stretched mat; and (f) heating said biaxially stretched mat in a thermofixing operation to a temperature above said stretching temperature to thermally fix the mat and form the web, the stretching in step (e) and the thermofixing in step (f) being so carried out that the polymer filaments of said web have at their centers a degree of crystallinity of at least 50%.

2. The process defined in claim 1 wherein in step (d) the points at which said filaments are fused together are distributed in both of said directions along said mat and have diameters of at least 1 mm, the process further comprising the step, between steps (d) and (e), of subjecting said mat to calendaring between rolls.

3. The process defined in claim 2 wherein the stretching in step (e) is carried out practically without damaging the points at which said filaments are fused together.

4. The process defined in claim 3 wherein said stretching temperature is maintained in a range of 80° to 150° C.

5. The process defined in claim 4 wherein said thermofixing temperature is maintained in a range of 180° to 200° C.

6. The process defined in claim 5 wherein the thermofixing in step (f) is carried out with heated air and surfaces of the polymer filaments are partly melted by the heated air.

7. The process defined in claim 6 wherein the stretching in step (e) and the thermofixing in step (f) are so carried out that the polymer filaments of said web have at their centers a degree of crystallinity of at least 75%.

8. The process defined in claim 7 wherein at said points said filaments form funnel-shaped projections which are pulled flat by the stretching of the mat in step (e).

9. The process defined in claim 7 wherein the stretching in step (e) and the thermofixing in step (f) are carried out in a continuous line with the formation of the mat.

10. The process defined in claim 7 wherein the stretching in step (e) and the thermofixing in step (f) are carried out in off line from the formation of the mat.

11. The process defined in claim 7 wherein the stretching in step (e) is carried out practically without damaging the points at which said filaments are fused together.

12. The process defined in claim 11 wherein said stretching temperature is maintained in a range of 80° to 150° C.

13. The process defined in claim 12 wherein said thermofixing temperature is maintained in a range of 180° to 200° C.

14. The process defined in claim 1 wherein said stretching temperature is maintained in a range of 80° to 150° C.

15. The process defined in claim 1 wherein said thermofixing temperature is maintained in a range of 180° to 200° C.

16. The process defined in claim 1 wherein the thermofixing in step (f) is carried out with heated air and surfaces of the polymer filaments are partly melted by the heated air.

17. The process defined in claim 1 wherein the stretching in step (e) and the thermofixing in step (f) are so carried out that the polymer filaments of said web have at their centers a degree of crystallinity of at least 75%.

18. The process defined in claim 1 wherein at said points said filaments form funnel-shaped projections which are pulled flat by the stretching of the mat in step (e).

19. The process defined in claim 1 wherein the stretching in step (e) and the thermofixing in step (f) are carried out in a continuous line with the formation of the mat.

20. The process defined in claim 1 wherein the stretching in step (e) and the thermofixing in step (f) are carried out in off line from the formation of the mat.

* * * * *